US007197906B2

(12) United States Patent
Tsuyuguchi et al.

(10) Patent No.: US 7,197,906 B2
(45) Date of Patent: Apr. 3, 2007

(54) COLD ROLLING PROCESS FOR METAL TUBES

(75) Inventors: Satoshi Tsuyuguchi, Hyogo (JP); Toshihide Ono, Hyogo (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/475,115

(22) Filed: Jun. 27, 2006

(65) Prior Publication Data

US 2006/0288750 A1 Dec. 28, 2006

(30) Foreign Application Priority Data

Jun. 28, 2005 (JP) ..... 2005-188365

(51) Int. Cl.
*B21B 17/04* (2006.01)

(52) U.S. Cl. ..... 72/208; 72/370.01

(58) Field of Classification Search ..... 72/208, 72/370.04, 367.1, 370.01, 235, 368, 370.05
See application file for complete search history.

(56) References Cited

U.S. PATENT DOCUMENTS 1,858,990 A * 5/1932 Foren ..... 72/208
2,074,271 A * 3/1937 Peters ..... 72/209
5,156,035 A * 10/1992 Lampe et al. ..... 72/206
5,218,851 A * 6/1993 Imae ..... 72/208
5,657,659 A * 8/1997 Yamada ..... 72/208
6,250,125 B1 * 6/2001 Ukai et al. ..... 72/214

FOREIGN PATENT DOCUMENTS

JP 6-019902 3/1994
JP 2001-105009 4/2001

* cited by examiner

*Primary Examiner*—Dmitry Suhol
(74) *Attorney, Agent, or Firm*—Clark & Brody

(57) ABSTRACT

In the cold rolling process by pilger rolling that holds a mandrel between each of paired roll-dies, by optimizing the side relief rate SR and the pass schedule factors such as the Area Rd, ID Rd and the feed rate F of the workpiece material, and further by properly selecting the taper θ1 in the primary deformation zone of mandrel and the taper θ2 in the final size reduction zone thereof, the dimension-related shape characteristics (near-perfect round shape) of the tube inside surface after the final finishing rolling process by pilger rolling can be ascertained to thereby ensure excellent surface property without requiring a new apparatus, and further without causing the decrease of the product yield and/or the increase of the manufacturing costs. Thus, this can be widely applied for producing steam generator tubes which exhibits high S/N ratio in the inner coil eddy current testing.

4 Claims, 4 Drawing Sheets

COLD ROLLING PROCESS FOR METAL TUBES

FIELD OF THE INVENTION

The present invention relates to a cold rolling process for metal tubes by pilger rolling, and more particularly, to a cold rolling process for metal tubes which have excellent dimensional accuracy after the final finishing stage as final sizing in pilger rolling, especially dimension-related shape characteristics (roundness) and surface property for the tube inside surface, thereby enabling to obtain a sufficiently high S/N ratio (signal to noise ratio) in conducting an inner coil eddy current testing.

DESCRIPTION OF THE RELATED ART

Usually, as a cold working process for metal tubes, a cold drawing process by a draw bench and a cold rolling process by a pilger mill are customarily applied. In particular, since a cold rolling process by a pilger mill has a feature such that tube materials can be cold worked with a high reduction rate in comparison with a cold drawing process, the cold rolling process by the pilger mill (pilger rolling) is generally applied in manufacturing metal tubes, using the tube materials with high-strength and less workability.

FIG. 1 is a diagram explaining the overall configuration of a pair of roll-dies to be used in pilger rolling. In the pilger rolling, there is provided a pair of roll-dies, an upper and lower roll-dies, each of which is provided with a roll caliber on its circumferential surface, whereas a mandrel with a taper such that the diameter thereof becomes smaller as nearing toward the front end is set between each of the above roll-dies. Each of roll-dies 10 is configured to have the roll caliber 11 on its circumferential surface and to be supported at a roll stand 12 by means of a roll shaft mounted at the center axis of the rolls. At one end of the roll shaft, a pinion gear 13 with the similar rotating diameter to that of roll-dies 10 is drivenly secured to a horizontally arranged rack gear 14.

The roll-dies 10 reciprocally rotate in the direction of the arrow B in cooperation with the reciprocating movement of the rack gear 14 in the direction of the arrow A via the pinion gear 13. Hence, the roll calibers 11 provided on the circumferential surface of the roll-dies 10 are to work and reduce the tube materials as work piece materials in association with the reciprocally rotating movement of the roll-dies 10.

FIG. 2 is a diagram showing a developed view of the roll caliber of roll-die in order to explain how the tube material is rolled in pilger rolling. In this diagram, there is described a schematic representation that, where the roll caliber bottom 11*e* of the roll-dies 10 subjects the tube material 1 to be worked and reduced, the whole path length from the head end dead center Sa to the bottom end dead center Sb is developed.

The roll caliber 11 provided on the circumferential surface of the roll-die 10 is configured to have an approximate oval shape of cross-section profile whose major axis is arranged to align in the width-wise direction, comprising a primary deformation zone 11*a* in which the cross-sectional radius of the roll caliber continuously becomes smaller from the deformation starting position "a" down to the deformation ending position "b" and a final size reduction zone 11*b* in which the cross-sectional radius stays same in the range from the above deformation ending position "b" on end down to the final sizing ending position "c", wherein a top relief 11*d* on the side of the head end dead center Sa in the primary deformation zone 11*a* and a bottom relief 11*c* on the side of the bottom end dead center Sb in the final size reduction zone 11*b* are provided respectively.

Between each of the paired roll-dies 10, a mandrel 20 having a primary deformation zone 21 and a final size reduction zone 22 such that its diameter becomes smaller as nearing the front end is provided, whereas the primary deformation zone 21 is made to have a taper θ1, and whereas the final size reduction zone 22 is made to have a taper θ2. The mandrel 20 is aligned so that its primary deformation zone 21 and final size reduction zone 22 are disposed so as to coincide with the primary deformation zone 11*a* and final size reduction zone 11*b* of the roll caliber 11 respectively during the rolling stroke.

Meanwhile, the tube material 1 as a workpiece material is given a predetermined feed rate while the roll-dies 10 reciprocally rotate (per one pass), and at the same time is given a turn of a predetermined angle, whereby the tube radius reducing and wall thinning in succession undergo. Namely, between the primary deformation zone 11*a* in the roll caliber 11 of roll-dies 10 and the primary deformation zone 21 of the mandrel 20, the tube radius reducing and wall thinning are provided, followed by the finishing work between the final size reduction zone 11*b* of the roll caliber 11 and the final size reduction zone 22 of the mandrel 20. Accordingly, the tube material 1 thus cold rolled is elongated corresponding to the plastic elongation rate by rolling and the feed rate for rolling, thus enabling to finally roll and finish to the aimed product dimension.

Because the cold rolling process by pilger rolling attributes to the rolling mechanism shown in the foregoing FIGS. 1 and 2, it becomes possible to apply a high reduction rate to the workpiece materials to thereby allow a higher reduction rate in cold working process in comparison with the cold drawing process as afore-mentioned. Usually, in the cold rolling process by pilger rolling, to apply a high reduction rate while not compromising the productivity, a relatively high feed rate F—i.e. about 4 mm per one pass—for the tube material and a cross-section area reduction rate (hereinafter referred to as "Area Rd") in the range of 70 to 90% are adopted. By the way, as a general common practice, the control of the inside diameter reduction rate (hereinafter referred to as "ID Rd") has been considered unnecessary.

FIG. 3 is a diagram showing a model of roll to be utilized in designing the caliber profile of the roll-die. In this diagram, there is described the roll caliber bottom 11*e* of the roll-die 10 subjecting the tube material 1 to be worked and reduced, whereas the tube inside surface is supported by the mandrel 20. In designing the roll caliber, as parameters contributing to the dimensional accuracy after the final finishing stage as final sizing in pilger rolling, a roll caliber diameter Dx and a side relief amount Fx in FIG. 3 are controlled.

In the cold rolling process by pilger rolling, the roll caliber diameter Dx is determined according to a pass schedule, while the side relief amount Fx is designed so that, to prevent the fin-like projection, the so-called overfill, on the tube outside surface from occurring, the ratio thereof is set to about 2%. Besides, the basic taper of the mandrel to be used, namely either the taper θ1 in the primary deformation zone or the taper θ2 in the final size reduction zone is set to 0.3 degree, and the boundary between the primary deformation zone and the final size reduction zone is deemed as the deformation ending position.

In the mean time, it has become to be required that, in the cold rolling process by pilger rolling, the dimension-related shape characteristics and/or surface property is adjusted to be best suited for the usage of the finished metal tubes. In this regard, there has been proposed to improve the dimensional accuracy etc. by utilizing various apparatus for the metal tubes to be made by the cold rolling process.

For instance, in Japanese Utility Model Publication No. 06-19902, there is proposed a cold pilger mill that includes an adjusting-and-reforming die arranged next to the in-process tube guides disposed onto a roll-die. The adjusting-and-reforming die is configured to automatically correct the in-process tube path of travel if there should slightly occur an off-set from the pass-line since it is designed to move in the direction perpendicular to the pass-line, and moreover is configured to turn, so that it can turn together with the in-process tube, thereby making it possible for the in-process tube to turn without hindrance. Accordingly, it is taught that, by combining the proposed adjusting-and-reforming die with the rolling process by the conventional cold pilger mill, a satisfactory dimensional accuracy equivalent to the case of the cold drawing process can be achieved without applying the cold drawing process.

Further, in Japanese Patent Application Publication No. 2001-105009, there is proposed a cold rolling process which employs rolling rolls preheated to the steady-state temperature during cold rolling by means of a low frequency induction heater. Namely, the above process is that in order to control the temperature of rolling rolls to be constantly in the steady-state during cold rolling, the temperature drop due to unforced cooling during the interval between the in-line assembling and the start of rolling is anticipated, and the rolls are heated at an off-line shop in advance to the temperatures higher than that in the steady-state, whereby the dimensional variation of dies becomes least and the dimensional variation of the rolled tubes is minimized, thus enabling to yield tubes having excellent dimensional accuracy.

However, the cold pilger mill or the cold rolling process proposed in the Japanese Utility Model Publication No. 06-19902 and Patent Application Publication No. 2001-105009 entails the new apparatus such as the adjusting-and-reforming die or the induction heater. Therefore, although employing these for the cold rolling by pilger rolling can ensure the required dimensional accuracy, it becomes necessary to newly modify/renovate the mill, thus resulting in the increase of the manufacturing costs of metal tubes thus cold rolled.

SUMMARY OF THE INVENTION

As for metal tubes to which a cold rolling process is applied as the final finishing rolling process, the steam generator tubes (SG tubes) can be exemplified. The finished diameter of the steam generator tubes is as small as 23 mm or less, so that although the cold drawing process by the draw bench can be applied as the finishing process, the problem arises such that the work defective like the slip and/or stick likely occurs during the drawing step, thus resulting in the decrease of the production yield. In this regard, it becomes necessary that the steam generator tubes are efficiently produced by the final cold rolling process by pilger rolling.

FIG. 4 is a diagram showing the model configuration of an inner coil eddy current testing apparatus to be applied for the periodic in-service inspection of steam generator tubes in Nuclear Power Plant. The eddy current testing apparatus 2 (comprising a probe 2*a* and coil 2*b*) shown in FIG. 4 travels the inside of the tubes to periodically check whether the flaw(s) is present on the inside surface of the tubes. Then when the surface property on the tube inside surface is in poor conditions during eddy current testing, for instance, when the concave/convex irregularities are formed on the tube inside surface, these should cause the noise signals to thereby hide the genuine flaw signals, thus likely increasing the risk to fail detecting harmful defects.

In this regard, when the inner coil eddy current testing is conducted under conditions that the S/N ratio is high, namely, the noise signals are low, the genuine flaw signals can be assuredly recognized, thus enabling to avoid failing to detect harmful defects. As a rough standard, it can be perceived that, as shown in the foregoing FIG. 4, in case the reference tube 3 be made to have a through-wall drill hole 3*a* of 0.66 mm in diameter which should constitute the artificial defect signal, it becomes necessary to ensure the S/N ratio to be 15 or more.

With regard to the generation of noise signals in the inner coil eddy current testing for metal tubes subjected to the cold rolling process by pilger rolling, the present inventor et al made an in-depth survey and investigations to end up in finding that a first and second aspects attribute to the dimensional variations in length-wise direction of the tubes, thereby causing the noise signals.

A first aspect is that, as recited with reference to the apparatus configuration shown in the foregoing FIGS. 1 and 2, the tube materials are rolled during the intermittent-wise reciprocally rotating movement of roll-dies in the cold rolling process by pilger rolling, and thus, minute concave/convex irregularities of a saw-teeth shape are formed with a certain length-wise pitch on the tube inside surface, thereby worsening the S/N ratio in the inner coil eddy current testing.

FIG. 5 is a diagram schematically showing minute concave/convex irregularities of a saw-teeth shape to be formed on the tube inside surface due to the cold rolling process by pilger rolling. The minute concave/convex irregularities 4 of a saw-teeth shape are attributable to the intermittent-wise reciprocally rotating movement of roll-dies, thus occurring with a reciprocation pitch of roll-dies. In this regard, in order to secure a high S/N ratio, it becomes necessary to minimize the concave/convex irregularities to be formed on the tube inside surface, or to avoid the generation of these irregularities.

A second aspect is that, likewise as recited with reference to the foregoing FIGS. 1 and 2, the tube materials as workpiece materials are rolled shortly after changing the phase angle by making a predetermined turn in the circumferential direction in association with the roll-dies movement, and thus, the cross-section profile of the tube inside commonly becomes oval and the oval appearance in phase-wise trajectory moves spirally over the entire length of the tube. The way things are, because the cross-section profile of the tube inside surface becomes oval, the S/N ratio in the inner coil eddy current testing deteriorates. In this regard, in order to increase/improve the S/N ratio, it becomes necessary to roll to get a round tube as much as possible, i.e. much nearer to the perfect round shape.

As afore-mentioned, in order to increase the S/N ratio of metal tubes subjected to the cold rolling process by pilger rolling, it becomes necessary to suppress the minute concave/convex irregularities of a saw-teeth shape to be formed on the tube inside surface and to secure excellent roundness. To that end, although it is possible to apply a cold drawing process as a final finishing process subsequent to the intermediate cold rolling process by pilger rolling, the trouble such as the slip and stick due to the lubrication performance during cold drawing likely occurs, thus increasing the work defective. Meanwhile, the adjusting-and-reforming die proposed in the Utility Model Publication No. 06-19902 can be one solution to be studied, but it involves the problems such as the modification/renovation of the equipment and the increase of manufacturing costs.

The present invention is attempted in view of the above problems, and its object is to provide a cold rolling process for metal tubes wherein without requiring a new equipment/apparatus as well as without causing the decrease of the product yield and the increase of the manufacturing costs, a high dimensional accuracy—especially, the dimension-related shape characteristics and surface property of the tube inside surface—after the final finishing stage in pilger rolling is achieved, and a sufficiently high S/N ratio in the inner coil eddy current testing can be achieved.

Hence, the inventor et al precisely looked into the tool design (roll-dies, mandrel) and pass schedule parameters, and noticed that, in order to secure dimension-related shape characteristics (roundness) of the tube inside surface after the final finishing stage in pilger rolling and to secure excellent surface property, it is effective to identify a first set of parameters contributing to suppressing the oval appearance of the tube inside surface from a second set of parameters contributing to suppressing the minute concave/convex irregularities of a saw-teeth shape on the tube inside surface and to optimize both sets of parameters respectively.

In concrete, it is found that: as the parameter for suppressing the oval appearance of the tube inside surface, it becomes essential to optimize the side relief rate SR of roll-dies: and, as the second set of parameters for suppressing the minute concave/convex irregularities of a saw-teeth shape on the tube inside surface, the decrease of ID Rd, the optimization of the feed rate F per one pass, and the decrease of the mandrel taper in its primary deformation zone as well as in the final size reduction zone are effective.

The present invention is completed based on the foregoing findings, and its gist pertains to the cold rolling process for metal tubes described in (1) and (2) as below.

(1) A cold rolling process for metal tubes in which the cold rolling process by pilger rolling that employs a pair of roll-dies with a roll caliber consisted of a roll caliber diameter Dx and a side relief amount Fx and holds a mandrel between said roll-dies is applied as a final finishing rolling process, wherein a side relief rate SR of said roll-dies expressed by the equation [1] as below is set in the range of 0.5 to 1.0%, and wherein in relation to a pass schedule, an Area Rd expressed by the equation [2] as below is set in the range of 70 to 90%, and an ID (inside diameter) Rd expressed by the equation [3] as below is set in the range of 25 to 40%, and wherein a feed rate (per one pass) of a workpiece material is set in the range of 1.0 to 3.0 mm:

$$SR(\%)=\{(2\times Fx)/(2\times Fx+Dx)\}\times 100 \quad [1]$$

$$\text{Area } Rd(\%)=\{1-(\text{Section Area After Rolling}/\text{Section Area Before Rolling})\}\times 100 \quad [2]$$

$$ID\ Rd(\%)=\{1-(ID \text{ After Rolling}/ID \text{ Before Rolling})\}\times 100 \quad [3]$$

(2) In the cold rolling process according to the above (1), it is preferable that a taper θ1 in the primary deformation zone of said mandrel is set to 0.2 degree or less, and a taper θ2 in the final size reduction zone of said mandrel is set to 0.1 degree or less as for a final finishing rolling by said cold rolling process.

According to the cold rolling process for metal tubes by the present invention, by optimizing the side relief rate SR of roll-dies, and the pass schedule parameters represented by the Area Rd, ID Rd and the feed rate F of the workpiece material, and further by properly selecting the taper θ1 in the primary deformation zone and the taper θ2 in the final size reduction zone of said mandrel, it becomes possible to secure good dimensional accuracy (near perfect roundness) of the tube inside surface after the final finishing process by pilger rolling without requiring a new equipment/apparatus as well as without causing the reduction of the product yield and the increase of the manufacturing costs, thereby enabling to secure excellent surface property. Thus, it becomes possible to ensure a sufficiently high S/N ratio in the inner coil eddy current testing for steam generator tubes in Nuclear Power Plant.

BREIF DESCRIPTION OF THE DRAWINGS

DETAILED DESCRIPTION OF THE PREFERRED EMBODIMENTS

In the cold rolling process according to the present invention, it is featured that in order to secure good dimensional accuracy (roundness) of the tube inside surface after the final finishing step by pilger rolling and to ensure an excellent surface property, the first set of parameters contributing to suppressing the oval appearance of the tube inside and the second set of parameters contributing to suppressing the minute concave/convex irregularities of a saw-teeth shape on the inside surface of tube are respectively assessed by identifying each parameter and optimizing it. In the following, the assessment results are outlined.

(Parameters Contributing to Suppressing the Oval Appearance of the Tube Inside Surface)

Figure 3:
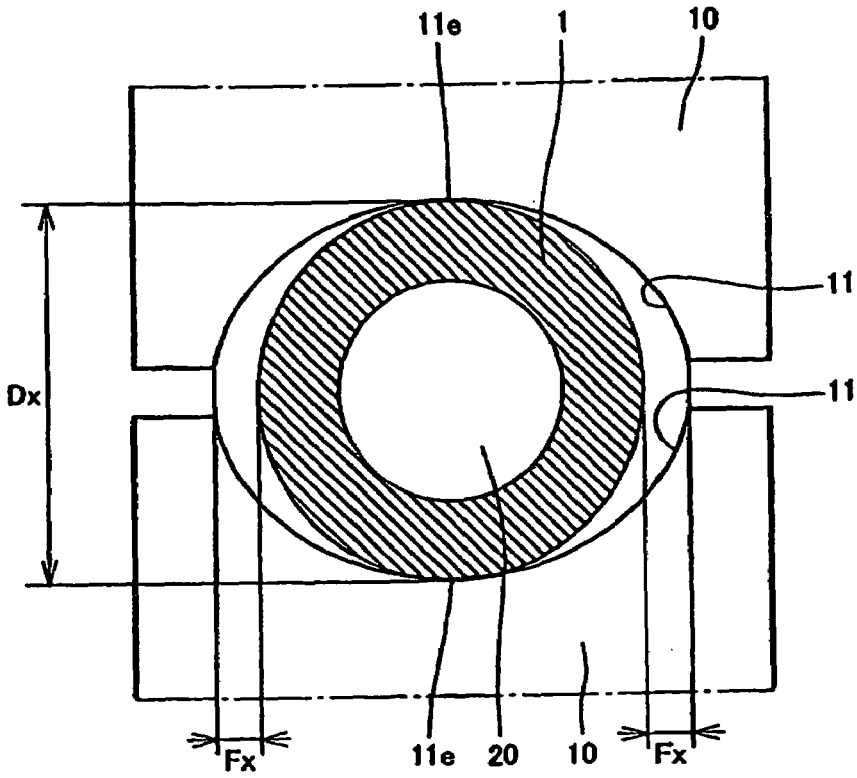
FIG. 3 is a diagram showing a model of roll to be utilized in designing the caliber profile of roll-die.
Figure 4:
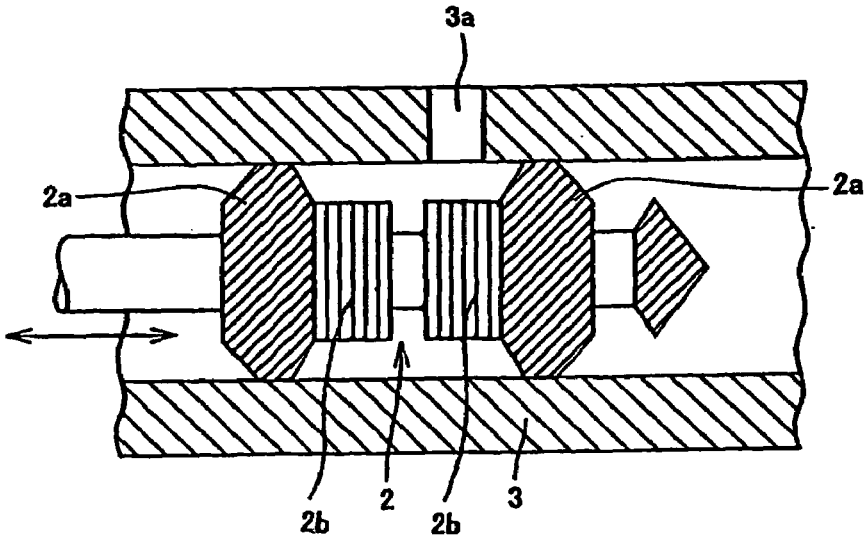
FIG. 4 is a diagram showing the model configuration of an inner coil eddy current testing apparatus to be applied for the periodic in-service inspection of steam generator tubes in Nuclear Power Plant.
Figure 5:
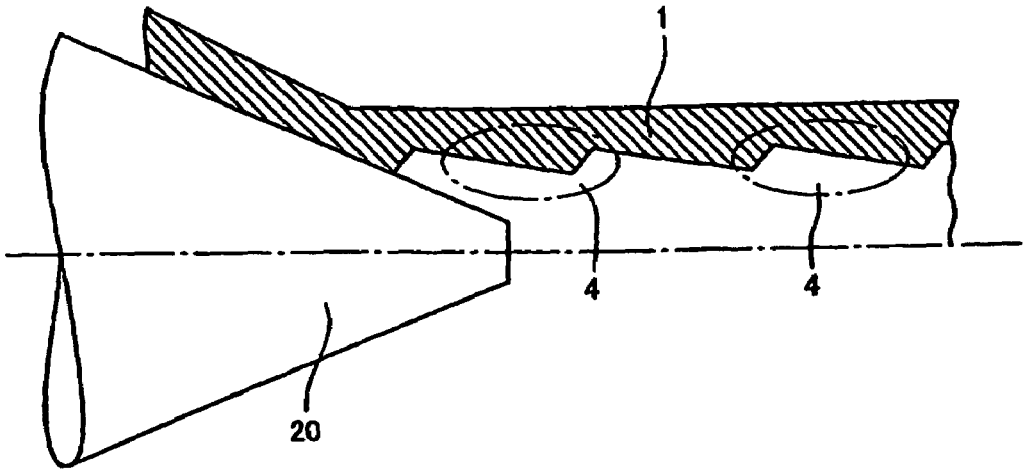
FIG. 5 is a diagram schematically showing minute concave/convex irregularities of a saw-teeth shape to be formed on the inside surface of tube due to the cold rolling process by pilger rolling.

As regards parameters for contributing to suppressing the oval appearance of the tube inside surface, a side relief rate SR of the roll-die is considered to be optimized. The side relief rate SR specified in the present invention is expressed by the equation [1] as below, where a representative caliber diameter is given by Dx and a side relief amount is given by Fx as shown in the foregoing FIG. 3, and is set to the range of 0.5 to 1.0%.

In the case that the side relief rate SR is below 0.5%, a fin-like projection occurs on the tube outside surface, the so-called overfill takes place, so that the cold rolling cannot be carried out successfully. Meanwhile, in the case that the side relief rate SR exceeds 1.0%, the oval appearance of the tube inside surface comes to be excessive, thus deteriorating the S/N ratio.

$$SR(\%)=\{(2\times Fx)/(2\times Fx+Dx)\}\times 100 \quad [1]$$

The side relief rate SR specified in the present invention is allowed to be calculated by the caliber profile factor (Dx, Fx) at least at the position corresponding to the rolling-work completion region, i.e., the deformation ending position "b". The side relief rate SR at other rolling-work region of the roll-die need not be specifically defined, but is preferably set in the range of 0.5 to 1.0%.

(Parameters Contributing to Suppressing Minute Concave/Convex Irregularities of a Saw-Teeth Shape on the Tube Inside Surface)

As regards parameters contributing to suppressing minute concave/convex irregularities of a saw-teeth shape on the tube inside surface, it is necessary for an ID Rd expressed by the equation [3] as below to be set in the range of 25 to 40%. Incidentally, in order to ensure the reduction rate in the cold rolling process by pilger rolling, the above is based on the premise that an Area Rd expressed by the equation [2] as below is set in the range of 70 to 90%.

$$\text{Area } Rd(\%)=\{1-(\text{Section Area After Rolling}/\text{Section Area Before Rolling})\}\times 100 \quad [2]$$

$$ID\ Rd(\%)=\{1-(ID\text{ After Rolling}/ID\text{ Before Rolling})\}\times 100 \quad [3]$$

Namely, in the cold rolling process according to the present invention, it becomes necessary not only to apply the high Area Rd number for high reduction rate but also to decrease the ID Rd. The imprint of the concave/convex of a saw-teeth shape on the inside surface of tube due to the reciprocally rotating movement of roll-dies is affected by the imparted work toward the inside diameter of tube material, so that by decreasing the ID Rd, the imprint of the concave/convex of a saw-teeth shape on the tube inside surface, which causes the noise signals, can be mitigated to thereby suppress the formation of the minute concave/convex irregularities. Hence, the S/N ratio on the tube inside after finishing rolling can be enhanced.

In this regard, the ID Rd must be lowered to be not more than 40%. But, in designing the pass schedule, there exists a lower limit in further decreasing the ID Rd while keeping the Area Rd to be high as much as 70–90%, and also, the roundness of rolled tubes is likely worsened as the ID Rd decreases, so that the lower limit thereof is set to 25%. The preferable range of ID Rd is 30 to 38%.

Next, as regards parameters contributing to suppressing the minute concave/convex irregularities of a saw-teeth shape on the tube inside surface, the feed rate F of the workpiece material (per one pass) need to be properly selected. Decreasing the feed rate F of the workpiece makes it possible to suppress the formation of the minute concave/convex irregularities on the tube inside surface, but ends up in lowering the productivity, thus being unable to be the base parameter for production. On the other hand, increasing the feed rate F can enhance the productivity, but results in making larger the minute concave/convex irregularities formed on the tube inside surface, thus reducing the S/N ratio. Accordingly, in the cold rolling process according to the present invention, the feed rate F of the workpiece is set in the range of 1.0 to 3.0 mm. Further, the preferable feed rate F is in the range of 1.0 to 2.5 mm.

Figure 1:
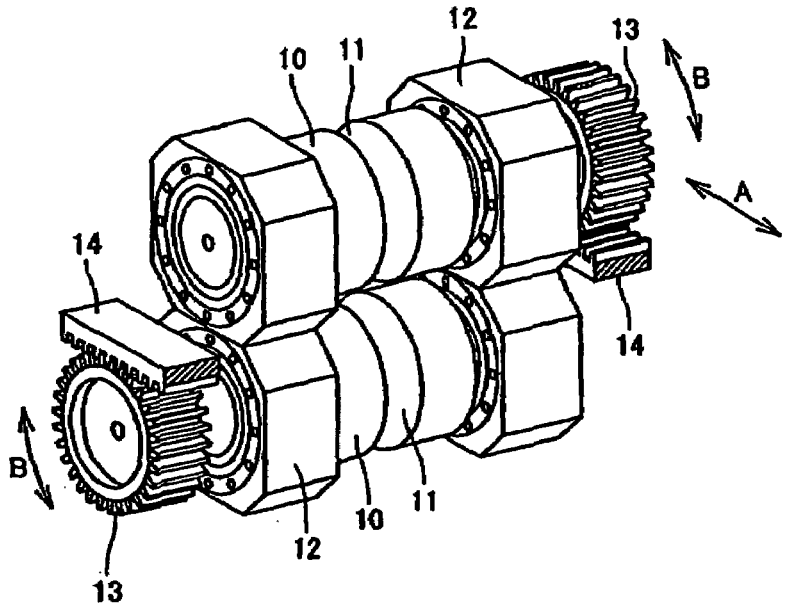
FIG. 1 is a diagram explaining the overall configuration of a pair of roll-dies to be used in pilger rolling.
Figure 2:
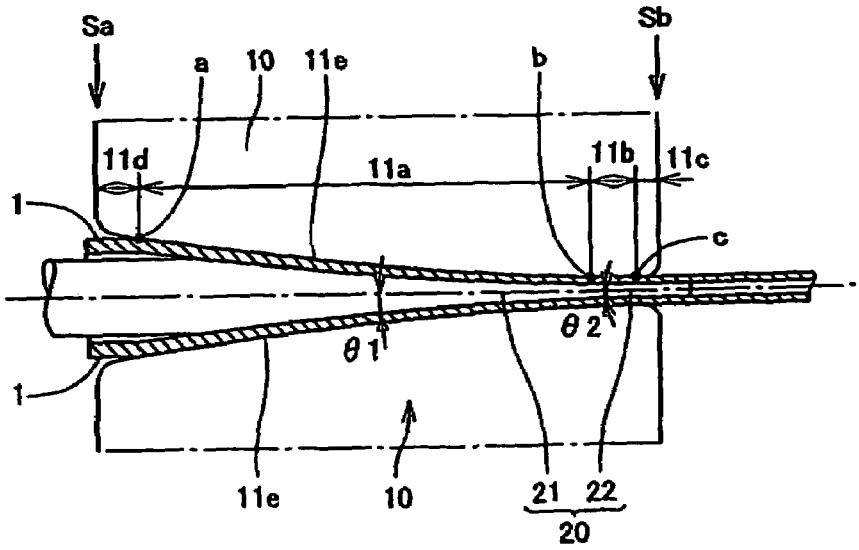
FIG. 2 is a diagram showing a developed view of the roll caliber of the roll-die in order to explain how the tube material is rolled in pilger rolling.

In order to further suppress the minute concave/convex irregularities of a saw-teeth shape on the tube inside surface, it is preferable that the taper θ1 of the primary deformation zone of the mandrel is preferably set to 0.2 degree or less, and the taper θ2 of the final size reduction zone thereof is set to 0.1 degree or less. The reason is that: As shown in the foregoing FIG. 2, in the case that the primary deformation zone as well as the final size reduction zone of the mandrel is provided with a continuous taper, it is commonly known that the concave/convex of a saw-teeth shape is imprinted onto the tube inside surface every each stroke of the reciprocally rotating movement of roll-dies: Hence, as each of said tapers becomes smaller, the formation of the minute concave/convex irregularities is suppressed further, and the high S/N ratio can be achieved.

In the cold rolling process according to the present invention, although each lower limit of the taper θ1 in the primary deformation zone of the mandrel and the taper θ2 in the final size reduction zone thereof is set to zero degree, it is preferable that the taper θ1 in the primary deformation zone is set to have a tapered configuration because the deformation work in reducing the radius of the tube material takes place in the manner of following the shape of the primary deformation zone of the mandrel to thereby ensure a high dimensional accuracy. In this regard, it is much preferable that the lower limit of the taper θ1 in the primary deformation zone is set to 0.1 degree.

Meanwhile, as regards the taper θ2 in the final size reduction zone, the slightly tapered configuration is effective to prevent the generation of the sticking and/or scratch imperfection on the tube inside surface by the contact with the mandrel after the cold rolling. In this regard, it is much preferable that the lower limit of the taper θ2 in the final size reduction zone is set to 0.01 degree.

EXAMPLES

Example 1

In Example 1, the S/N ratio is investigated on the cases that the roll-dies with variance of the side relief SR in the final finishing rolling are employed, and while keeping the ordinary Area Rd (about 80%), the ID Rd is varied. As the test materials, the billets made of the materials corresponding to NCF690TB (30Cr-60Ni) specified in JIS Standard are prepared, and subjected to hot extrusion process to yield the tube blanks of 55 mm in outside diameter×32 mm in inside diameter, followed by grinding the outside surface thereof to make 54.75 mm in outside diameter×32 mm in inside diameter, to be the tube materials for pilger rolling.

As regards the pass schedule in Inventive Examples (Test Nos. 1, 2), the tube materials thus made are subjected to a preliminary rolling process to make the intermediate tubes of 23 mm in outside diameter×16.4 mm in inside diameter. Incidentally, the applied ID Rd is 48.8% and the Area Rd is 86.8%.

In the subsequent final finishing rolling, the roll-dies whose side relief rate SR are varied to 0%, 0.5%, 1.0%, 1.5% and 2.0% (5 variants in all) and the mandrel where the taper θ1 in the primary deformation zone and the taper θ2 in the final size reduction zone are varied are employed to make the metal tubes of 12.85 mm in outside diameter× 10.67 mm in inside diameter by the finishing rolling. The parameters such as the Area Rd, ID Rd, the mandrel variants like the taper θ1 in the primary deformation zone and the taper θ2 in the final size reduction zone, and the feed rate F are shown in Table 1.

As regards the pass schedule in the case of the Comparative Example (Test No. 3), the tube materials as above are subjected to a preliminary rolling process to make the intermediate tubes of 25 mm in outside diameter×19 mm in inside diameter. Incidentally, the applied ID Rd is 40.6% and the Area Rd is 86.6%.

Likewise, in the subsequent final finishing rolling process, the roll-dies whose side relief rate SR are varied to 0%, 0.5%, 1.0%, 1.5% and 2.0% (5 variants in all) is employed to make the metal tubes of 12.85 mm in outside diameter× 10.67 mm in inside diameter by the finishing rolling. The parameters such as the Area Rd, ID Rd, the mandrel variants like the taper θ1 in the primary deformation zone and the taper θ2 in the final size reduction zone, and the feed rate F are shown in Table 1. However, in the case of 0% in side relief rate SR, the overfill was caused for each run, so that the cold rolling process could not be applied.

TABLE 1

(Pass Schedule in the Final Finishing Rolling Process)

| Test No. | Side Relief Rate SR (%) | Area Rd (%) | ID Rd (%) | Taper of Mandrel θ1 (degree) | Taper of Mandrel θ2 (degree) | Feed Rate F (mm) |
|---|---|---|---|---|---|---|
| 1 | 0~2.0 (5 variants) | 80.3 | 34.9 | 0.3 | 0.3 | 2.5 |
| 2 | 0~2.0 (5 variants) | 80.3 | 34.9 | 0.1 | 0.01 | 2.5 |
| 3 | 0~2.0 (5 variants) | 80.6 | *43.8 | 0.3 | 0.3 | 2.5 |

(Note)
The symbol * denotes the deviation from the specified range by the present invention.

Each inside surface of the tubes made by the final finishing rolling process with parameters shown in Table 1 is subjected to the inner coil eddy current testing employing 750 kHz in frequency and the differential bobbin coil method, wherein the through-wall drill hole of 0.66 mm in diameter is used as the calibration standard or an artificial defect and the S/N ratio is investigated.

Figure 6:
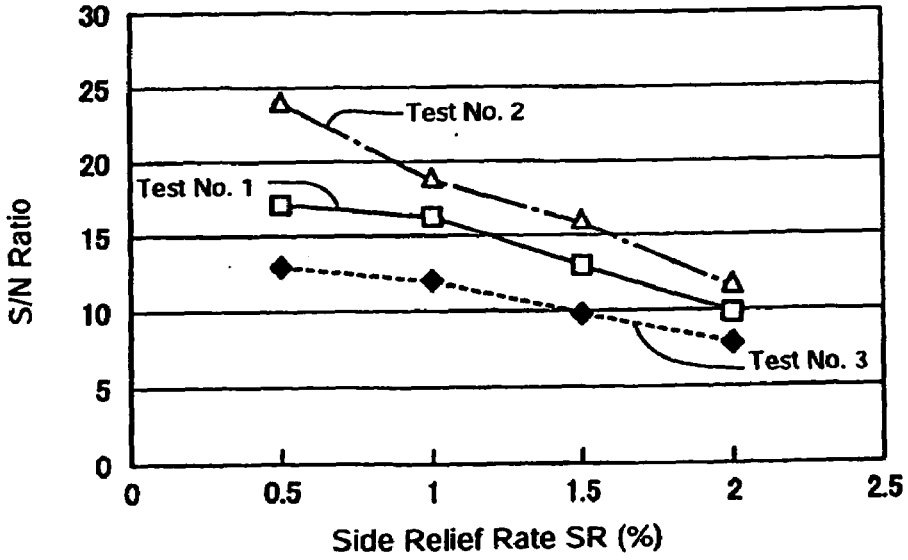
FIG. 6 is a diagram showing the investigation results on the S/N ratio in Example 1.

FIG. 6 is a diagram showing the investigation results on the S/N ratio in Example 1. In Example 1, while the feed rate F is set to 2.5 mm which is relatively low (ordinarily 4 mm), the pass schedule in the Inventive Examples (Test Nos. 1, 2) assures that a higher S/N ratio can be achieved by decreasing the ID Rd while securing the high Area Rd, whereas in the case of the pass schedule in Comparative Example (Test No. 3), the S/N ratio remains to be less than 15 irrespective of the side relief rate SR.

According to the pass schedule in the Inventive Examples (Test Nos. 1, 2), selecting the side relief rate SR in the range of 0.5 to 1.0% can ensure the S/N ratio of 15 or more. Further, in Test No. 2 of the Inventive Example, the taper θ1 in the primary deformation zone of the mandrel and the taper θ2 in the final size reduction zone thereof being decreased, much higher S/N ratio can be achieved.

Example 2

In Example 2, together with the variation of the taper θ1 in the primary deformation zone of the mandrel in the final finishing rolling process, the feed rate F is also varied to investigate those effects on S/N ratio. Similarly to the Example 1, as the test materials, the billets made of the materials corresponding to NCF690TB (30Cr-60Ni) specified in JIS Standard are prepared, and subjected to hot extrusion process to yield the tube blanks of 55 mm in outside diameter×32 mm in inside diameter, followed by grinding the outside surface thereof to make 54.75 mm in outside diameter×32 mm in inside diameter, to be the tube materials for pilger rolling.

The pass schedule in Example 2 (Test Nos. 4, 5) is set similarly to the Inventive Example (Test Nos. 1, 2) in Example 1, and the intermediate tubes of 23 mm in outside diameter×16.4 mm in inside diameter are made by a preliminary rolling process (the ID Rd is 48.8% and the Area Rd is 86.8%).

In the subsequent final finishing rolling, the roll-dies in which the side relief rate SR is set to 0.5% and the mandrel where the taper θ1 in the primary deformation zone is varied are employed, and the feed rate F is varied to 1.5 mm, 2.0 mm, 2.5 mm, 3.0 mm and 3.5 mm (5 variants in all) to make the metal tubes of 12.85 mm in outside diameter×10.67 mm in inside diameter by the finishing rolling. The parameters such as the Area Rd, ID Rd, the mandrel variants like the taper θ1 in the primary deformation zone and the taper θ2 in the final size reduction zone, and the feed rate F are shown in Table 2.

TABLE 2

(Pass Schedule in the Final Finishing Rolling Process)

| Test No. | Side Relief Rate SR (%) | Area Rd (%) | ID Rd (%) | Taper of Mandrel θ1 (degree) | Taper of Mandrel θ2 (degree) | Feed Rate F (mm) |
|---|---|---|---|---|---|---|
| 4 | 0.5 | 80.3 | 34.9 | 0.3 | 0.01 | 1.5~*3.5 (5 variants) |
| 5 | 0.5 | 80.3 | 34.9 | 0.1 | 0.01 | 1.5~*3.5 (5 variants) |

(Note)
The symbol * denotes the deviation from the specified range by the present invention.

Similarly to Example 1, the each inside surface of the tubes made by the final finishing rolling process with parameters shown in Table 2 is subjected to the inner coil eddy current testing, employing 750 kHz in frequency and the differential bobbin coil method, wherein the through-wall drill hole of 0.66 mm in diameter is used as the calibration standard or an artificial defect and the S/N ratio is investigated.

Figure 7:
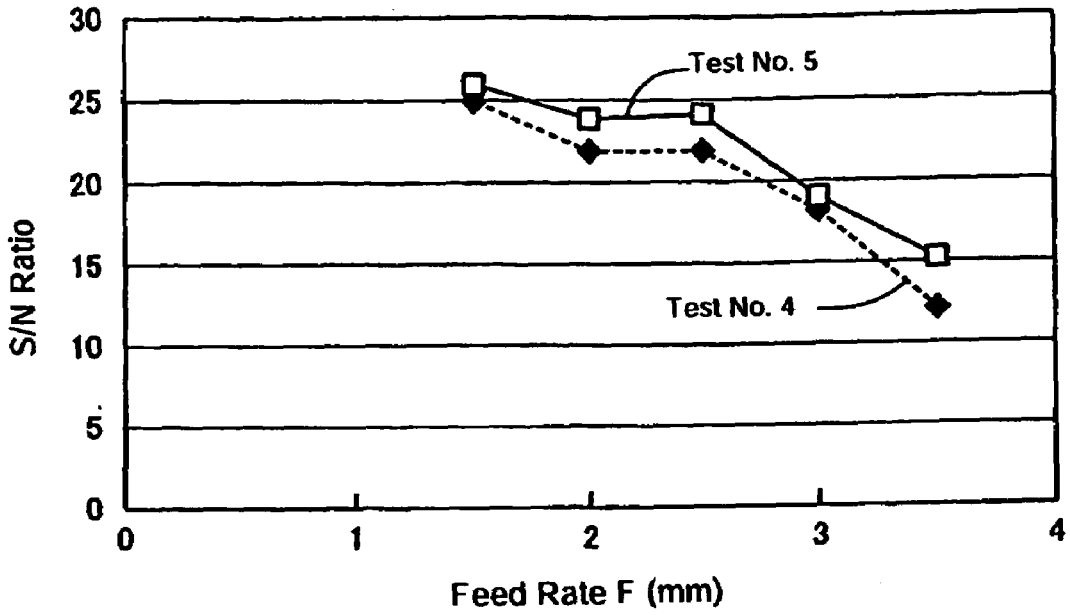
FIG. 7 is a diagram showing the investigation results on the S/N ratio in Example 2.

FIG. 7 is a diagram showing the investigation results on the S/N ratio in Example 2. As being evident from the results shown in the diagram, by rolling with the pass schedule of 34.9% in ID Rd, as far as the feed rate F is 3.0 mm or less, the S/N ratio exceeds 15 and can stay at the higher level. Therefore, as regards the pass schedule according to the present invention, the feed rate F is set in the range of 1.0 to 3.0 mm in order to secure high S/N ratio while maintaining the productivity.

Further, from the results shown FIG. 7, it is confirmed that by lowering the taper θ1 in the primary deformation zone of the mandrel, the higher S/N ratio can be achieved.

Example 3

In Example 3, the taper θ1 in the primary deformation zone of the mandrel and the taper θ2 in the final size reduction zone thereof as for the final finishing rolling process are respectively varied to investigate those effects on S/N ratio. Similarly to the Example 1, as the test materials, the billets made of the materials corresponding to NCF690TB (30Cr-60Ni) specified in JIS Standard are prepared, and subjected to hot extrusion process to yield the tube blanks of 55 mm in outside diameter×32 mm in inside diameter, followed by grinding the outside surface thereof to make 54.75 mm in outside diameter×32 mm in inside diameter, to be the tube material for pilger rolling.

The pass schedule in Example 3 (Test No. 6) is set similar to the Inventive Example (Test Nos. 1, 2) in Example 1, and the intermediate tubes of 23 mm in outside diameter×16.4 mm in inside diameter are made by a preliminary rolling process (the ID Rd is 48.8% and the Area Rd is 86.8%), followed by the subsequent final finishing rolling process employing the mandrel where its taper θ1 in the primary deformation zone is varied to 0.1 degree to 0.3 degree (4 variants) and its taper θ2 in the final size reduction zone is varied to 0.01 degree to 0.3 degree (4 variants) to make the metal tubes of 12.85 mm in outside diameter×10.67 mm in inside diameter by the finishing rolling. The parameters such as the Area Rd, ID Rd, the mandrel factors like the taper θ1 in the primary deformation zone and the taper θ2 in the final size reduction zone, and the feed rate F are shown in Table 3.

TABLE 3

(Pass Schedule in the Final Finishing Rolling Process)

| Test No. | Side Relief Rate SR (%) | Area Rd (%) | ID Rd (%) | Taper of Mandrel θ1 (degree) | Taper of Mandrel θ2 (degree) | Feed Rate F (mm) |
|---|---|---|---|---|---|---|
| 6 | 0.5 | 80.6 | 34.9 | 0.3 | 0.01 | 2.5 |
| | | | | 0.25 | 0.03 | |
| | | | | 0.2 | 0.1 | |
| | | | | 0.1 | 0.3 | |

Similarly to Example 1, the each inside surface of the tubes made by the final finishing rolling process with parameters shown in Table 3 is subjected to the inner coil eddy current testing employing 750 kHz in frequency and the differential bobbin coil method, wherein the through-wall drill hole of 0.66 mm in diameter is used as the calibration standard or an artificial defect and the S/N ratio is investigated. The investigation results are shown in Table 4.

TABLE 4

(Results of Test No. 6)

| S/N ratio | | Final Size Reduction Zone θ2 0.01 | 0.03 | 0.1 | 0.3 |
|---|---|---|---|---|---|
| Deformation Zone θ1 | 0.3 | 22 | 20 | 18 | 17 |
| | 0.25 | 22 | 22 | 18 | 17 |
| | 0.2 | 22 | 22 | 22 | 17 |
| | 0.1 | 24 | 22 | 21 | 19 |

Note) The unit of θ1 and θ2 in the above Table is "degree".

From the results shown in Table 4, as far as the caliber profile (the side relief rate SR is 0.5%) and the pass schedule (the ID Rd is 34.9%) fall within the specified range according to the present invention, the S/N ratio becomes high as much as 15 or more even if the prior art mandrel comprising the taper θ1 of 0.3 degree in the primary deformation zone of the mandrel and the taper θ2 of 0.3 degree in the final size reduction zone is employed.

Further, in view of the aspect that as the taper becomes smaller, the higher S/N ratio can be achieved, it is confirmed that the preferable taper θ1 in the primary deformation zone is 0.2 degree or less and the preferable taper θ2 in the final size reduction zone is 0.1 degree or less.

As recited as above, by optimizing the side relief rate SR and the pass schedule factors such as the Area Rd, ID Rd and the feed rate F of the workpiece material, and further by properly selecting the taper θ1 in the primary deformation zone of the mandrel and the taper θ2 in the final size reduction zone thereof, the cold rolling process for metal tubes according to the present invention can secure the dimension-related shape characteristics (near-round shape) of the tube inside surface after the final finishing rolling process by pilger rolling to ensure excellent surface property without requiring a new apparatus, and further without causing the decrease of the product yield and/or the increase of the manufacturing costs. Thus, this can be widely applied for producing steam generator tubes which exhibit high S/N ratio in the inner coil eddy current testing.

What is claimed is:

1. A cold rolling process for metal tubes in which the cold rolling process by pilger rolling that employs a pair of roll-dies with a roll caliber comprising a roll caliber diameter Dx and a side relief amount Fx and holds a mandrel between said roll-dies is applied as a final finishing process, wherein a side relief rate SR of said roll-dies expressed by the equation [1] as below is set in the range of 0.5 to 1.0%, and wherein in relation to a pass schedule, an Area Rd expressed by the equation [2] as below is set in the range of 70 to 90%, an ID (inside diameter) Rd expressed by the equation [3] as below is set in the range of 25 to 40%, and a feed rate F (per one pass) of a workpiece material is set in the range of 1.0 to 3.0 mm:

$$SR(\%)=\{(2\times Fx)/(2\times Fx+Dx)\}\times 100 \quad [1]$$

$$\text{Area } Rd(\%)=\{1-(\text{Section Area After Rolling}/\text{Section Area Before Rolling})\}\times 100 \quad [2]$$

$$ID\ Rd(\%)=\{1-(ID\ \text{After Rolling}/ID\ \text{Before Rolling})\}\times 100 \quad [3].$$

2. A cold rolling process for metal tubes according to claim 1, wherein, employing said mandrel configured in such a way that a taper θ1 in the primary deformation zone of said mandrel is set to 0.2 degree or less, and a taper θ2 in the final size reduction zone of said mandrel is set to 0.1 degree or less, a final finishing rolling process is applied.

3. A cold rolling process for metal tubes according to claim 1, wherein a S/N ratio is 15 or more when an eddy current testing by means of the eddy current testing apparatus comprising 750 kHz in frequency and the differential bobbin coil method is carried out, using a through-wall drill hole of 0.66 mm in diameter as a calibration standard or an artificial defect, for each inside surface of said metal tubes made by the final finishing rolling process.

4. A cold rolling process for metal tubes according to claim 2, wherein a S/N ratio is 15 or more when an eddy current testing by means of the eddy current testing apparatus comprising 750 kHz in frequency and the differential bobbin coil method is carried out, using a through-wall drill hole of 0.66 mm in diameter as a calibration standard or an artificial defect, for each inside surface of said metal tubes made by the final finishing rolling process.

* * * * *